US008764086B1

(12) United States Patent
Swartzburg

(10) Patent No.: US 8,764,086 B1
(45) Date of Patent: Jul. 1, 2014

(54) DEVICE FOR CARRYING A PLURALITY OF BAGS HAVING HANDLES

(76) Inventor: Rick T. Swartzburg, Westlake Village, CA (US)

( * ) Notice: Subject to any disclaimer, the term of this patent is extended or adjusted under 35 U.S.C. 154(b) by 259 days.

(21) Appl. No.: 13/135,447

(22) Filed: Jul. 6, 2011

(51) Int. Cl.
*A45F 5/00* (2006.01)
*B65D 33/06* (2006.01)

(52) U.S. Cl.
USPC ..... 294/171; 294/137

(58) Field of Classification Search
USPC ..... 294/171, 137, 170; D9/434; 16/425, 16/430, 431; 383/13
See application file for complete search history.

(56) References Cited

U.S. PATENT DOCUMENTS

| | | | | | |
|---|---|---|---|---|---|
| 2,448,894 | A * | 9/1948 | Laus | 294/171 |
| 5,364,148 | A * | 11/1994 | Bartocci | 294/171 |
| D384,279 | S * | 9/1997 | Hepworth | D9/434 |
| 5,771,536 | A * | 6/1998 | Sieg et al. | 16/431 |
| 5,884,955 | A * | 3/1999 | Pucillo | 294/171 |
| D448,992 | S * | 10/2001 | Bargsten et al. | D9/434 |
| D489,976 | S * | 5/2004 | Whitney | D9/434 |
| 7,387,324 | B1 * | 6/2008 | Sharpe | 294/171 |
| 2004/0126556 | A1 * | 7/2004 | Nowak et al. | 428/304.4 |
| 2006/0163894 | A1 * | 7/2006 | Mishek et al. | 294/171 |

* cited by examiner

*Primary Examiner* — Paul T Chin
(74) *Attorney, Agent, or Firm* — Ted Masters

(57) ABSTRACT

A device for carrying a plurality of bags having handles is made from one piece visco-elastic foam and has a longitudinal cavity which receives the handles of the bags. A user grips the device and the device molds abound the handles and to the hand of the user, thereby forming a protective cushioned handle which facilitates the carrying process.

1 Claim, 5 Drawing Sheets

Fig. 2
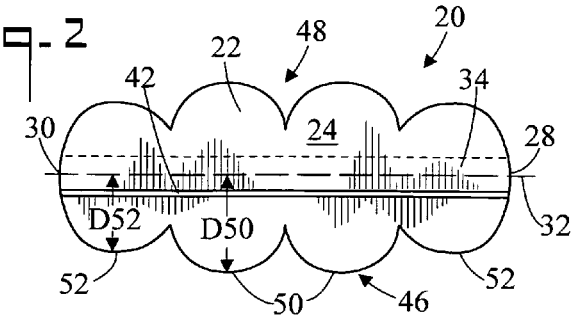
Fig. 3
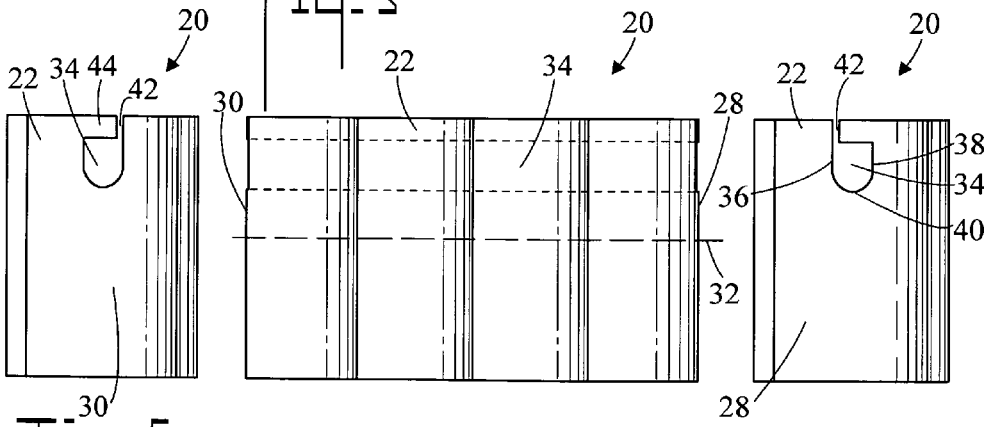
Fig. 5
Fig. 4
Fig. 6
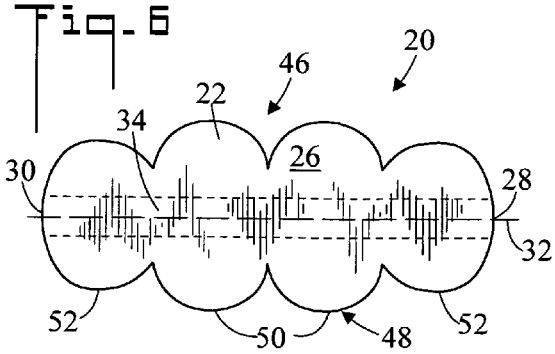

DEVICE FOR CARRYING A PLURALITY OF BAGS HAVING HANDLES

CROSS REFERENCE TO RELATED APPLICATION

None

TECHNICAL FIELD

The present invention pertains generally to bags such as shopping bags which have handles, and more particularly to a device for carrying a plurality of such bags.

BACKGROUND OF THE INVENTION

Shopping bags are well known in the art. These bags typically include a top portion which has two sides. A carrying handle is attached to each of the sides, thereby permitting the bags to be carried by a user. Problems can exist however when multiple and/or bags with heavy contents are carried. Multiple handles can be difficult for the user to grip with a single hand, and bags with heavy contents can cause the handles to cut into the user's hand causing discomfort and pain.

BRIEF SUMMARY OF THE INVENTION

The present invention is directed to a device for conveniently and more efficiently carrying a plurality of bags having handles. The present invention addresses the problems associated with carrying multiple heavy bags by utilizing a slow recovery visco-elastic (visco-elastic) foam designed to be easily and rapidly placed over the thinner handles to form a molded cushion. The device molds to the contour of both the handle(s) and the user's hand to form a three dimensional mold that will give added strength, support, protection and adherence as the handles and hand form a mold from the pressure being applied by the closure of the hand and opposing weight from the handle.

The device will remain in the same initially placed location around the handles, without pulling free or moving once the bags are put down and then picked back up. Additionally, due to the slow recovery visco-elastic properties of the foam, air is be removed from the device as it is gripped in by the hand and the device completely conforms to the users hand and around the handles. As such it is a one size fits all grip. With this ability to remove the air from the cells as the device is compressed, but then come back to the same exact shape upon removal of pressure, the device becomes a perfect way to orthopedically exercise the hand to reduce the continued pressure applied while squeezing the hand to carry an object for too long of a period of time. This can be accomplished by squeezing and unsqueezing the hand during the carrying of the weighted bags, or by just using it separately when not in use for carrying to receive the benefit of finger orthopedic exercises. This can not occur in a material that would not deform enough to allow the hand to actually open and close significantly during loading and unloading of the hand grip. The properties of the visco-elastic material make it a perfect stress relieving device, due to its ease of compression and pleasing feel.

Additionally, the visco-elastic material allows the grip to start off larger and therefore easier to grab, but then compress to down to fit the grip of the user. The properties of this material prevent the deforming that would occur with applied pressure of other types of more resilient and quicker reacting material like foamed rubber. With the ability to be compressed down to virtually any size, a normal strength individual should be easily able to compress it down to ⅓ of its original size for easier storage in small pouch. This makes the grip advantageous for traveling. As a one piece, totally malleable material without any rigid center piece, it can be squeezed completely down with, without hitting any rigid center piece, thereby making it ideal as a stress reliever or orthopedic exercise grip.

The device has a cavity which accepts the bag handles. As needed the cavity can stretch to accommodate a large number of handles, while remaining closed due to a flap and a slit on the top. That flap will open and close easily with pressure, but will always reseal on its own and pressure will always be applied against the handles to make them more cohesively unified inside the grip.

The visco-elastic material is friction enhancing to reduce slipping of the hand and the handles. The device will remain at the center/top of the handles when the bags are set down upon a support surface.

Use of a firmer ILD (indentation load deflection) visco-elastic foam allows for the compression strength needed with the weight of the handles, while still reacting the heat of the palm to easily shape the grip down to the proper size of the user's hand.

In accordance with an embodiment, a device for carrying a plurality of bags having handles includes a body which is made from visco-elastic foam. The body includes a receiver for removably receiving the handles of the bags.

In accordance with another embodiment, the body includes a top surface, a bottom surface, a first end, an opposite second end, and a central longitudinal axis which passes from the first end to the second end. The body also includes a longitudinal cavity which is oriented parallel to the central longitudinal axis, the longitudinal cavity extends from the first end to the second end, and the longitudinal cavity is disposed between the central longitudinal axis and the top surface. The longitudinal cavity is shaped and dimensioned to receive the handles of the bags.

In accordance with another embodiment, the longitudinal cavity is formed by a first wall, an opposite second wall, and a rounded floor.

In accordance with another embodiment, a longitudinal slit extends from the first end of the body to the second end of the body, and from the top surface to the longitudinal cavity. The longitudinal slit allows passage of the handles of the bags into the longitudinal cavity.

In accordance with another embodiment, the longitudinal slit is oriented perpendicular to the top surface, is oriented parallel to the central longitudinal axis, and is adjacent to the first wall of the longitudinal cavity.

In accordance with another embodiment, a movable flap covers the longitudinal cavity.

In accordance with another embodiment, the body has a first side and an opposite second side. The first and second sides are scalloped and forming a plurality of vertically oriented elongated humps.

In accordance with another embodiment, the first side and the second side each have four scallops including two middle scallops which define two elongated middle humps, and two end scallops which define two elongated end humps. The elongated middle humps extend further outwardly from the central longitudinal axis than do the elongated end humps.

In accordance with another embodiment, the device is made from visco-elastic foam only.

In accordance with another embodiment, the body has an uncompressed state which has a first volume, and a compressed state which has a second volume. The first volume is at least three times larger than the second volume.

In accordance with another embodiment, the visco-elastic foam has an ILD of between about 40 and about 100.

In accordance with another embodiment, the visco-elastic foam has a tensile strength of greater than 20 pounds per square inch.

In accordance with another embodiment, the visco-elastic foam has a tear strength of greater than 4 pounds per inch.

In accordance with another embodiment, the visco-elastic foam has a ball rebound value of less than one percent.

Other possible embodiments, in addition to the possible embodiments enumerated above, will become apparent from the following detailed description, taken in conjunction with the accompanying drawings, which illustrate, by way of example, the principles of the device.

BRIEF DESCRIPTION OF THE DRAWINGS

FIG. 2 is a top plan view of the device;

FIG. 3 is a side elevation view of the device;

FIG. 4 is an end elevation view of the device;

FIG. 5 is an opposite end elevation view;

FIG. 6 is a bottom plan view;

DETAILED DESCRIPTION OF THE INVENTION

Figure 1:
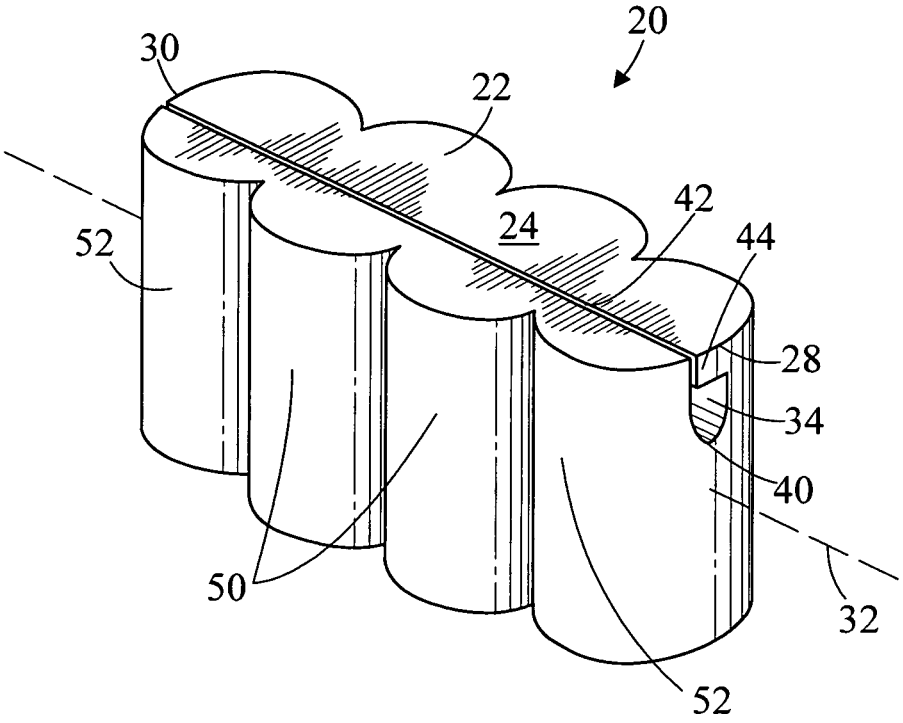
FIG. 1 is a perspective view of a device for carrying bags having handles.
Figure 7:
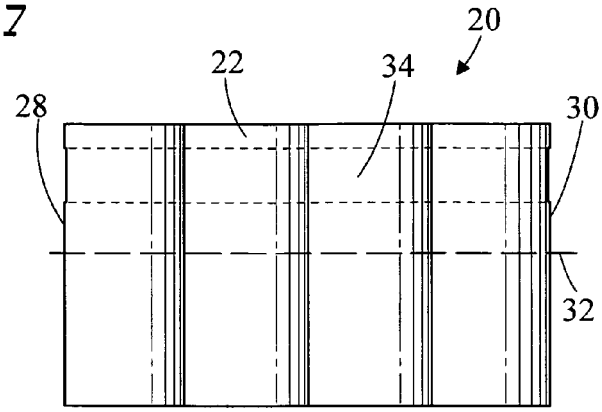
FIG. 7 is an opposite side elevation view.

Referring initially to FIGS. 1-7, there are illustrated perspective, top plan, side elevation, end elevation, opposite end elevation, bottom plan, and opposite side elevation views respectively of a device for carrying a plurality of bags having handles, generally designated as 20. FIGS. 8, 9, 10, 13, 15, and 16 show device 20 connected to the handles 502 of bags 500. Bags 500 are typically shopping bags, and can be made of paper, plastic, cloth, or any other suitable material. Handles 502 are attached to the top of bags 500, and can be made from string, rope, twine, paper, plastic, cloth, or any other suitable material. In the shown embodiment, each bag 500 has two handles 502.

Device 20 includes a body 22 which is made from low-resilience visco-elastic polyurethane foam (also know as "memory foam"). In an embodiment, device 20 is made from one solid piece of visco-elastic foam, and contains no core or other material. Body 22 includes a receiver for removably receiving handles 502 of bags 500. Body 22 includes a top surface 24, a bottom surface 26, a first end 28, an opposite second end 30, and a central longitudinal axis 32 which passes from first end 28 to second end 30. As used herein, the terms top and bottom pertain to the position of device 20 when it is being used. In the shown embodiment, the receiver includes body 22 having a longitudinal cavity 34 which is oriented parallel to central longitudinal axis 32. Longitudinal cavity 34 extends from first end 28 to second end 30, and is disposed between central longitudinal axis 32 and top surface 24. Longitudinal cavity 34 is shaped and dimensioned to longitudinally receive handles 502 of bags 500. Referring particularly to FIG. 4, longitudinal cavity 34 is formed by a first wall 36, an opposite second wall 38, and a rounded floor 40 (semicircular in the shown embodiment). A longitudinal slit 42 extends from first end 28 to second end 30, extends from top surface 24 to longitudinal cavity 34, and allows passage of handles 502 of bags 500 into longitudinal cavity 34 (refer to FIG. 12 and the associated discussion). In the shown embodiment, longitudinal slit 42 is oriented perpendicular to top surface 24, parallel to central longitudinal axis 32, and is adjacent to first wall 36 of longitudinal cavity 34. A movable flap 44 covers longitudinal cavity 34, and serves to retain handles 502 within longitudinal cavity 34. Movable flap is defined by top surface 24, longitudinal slit 42, and the top of longitudinal cavity 34.

Body has a first side 46 and an opposite second side 48. First 46 and second 48 sides are scalloped and form a plurality of vertically oriented elongated humps. That is, the vertically oriented elongated humps are perpendicular to top surface 24 and bottom surface 26. In the shown embodiment, first side 46 and said second side 48 each having four scallops including two middle scallops which define two rounded elongated middle humps 50, and two end scallops which define two rounded elongated end humps 52. Middle humps 50 extend further outwardly from central longitudinal axis 32 than do end humps 52 (refer to distances D50 and D52 of FIG. 2).

In an embodiment, the visco-elastic foam has an indention load deflection (ILD), also know as indention force deflection (IFD), value of between about 40 and about 100, with about 65 being found quite useful. It is noted that ILD is measured in pounds.

In an embodiment, the visco-elastic foam has a tensile strength of greater than 20 pounds per square inch (psi). According to the PFA® (Polyurethane Foam Association), tensile strength is measured using the method specified in ASTM D3574, and is the pounds per square inch of force required to stretch a material to the breaking point.

In an embodiment, the visco-elastic foam has a tear strength of greater than 4 pounds per inch. The PFA® defines tear strength as the force required to continue a tear in a foam after a split or break has been started, and is expressed in pounds per inch.

In an embodiment, the visco-elastic foam has a ball rebound value of less than one percent. A rebound test measures a foam's springiness by determining the percent rebound of a steel ball which is dropped on the foam from a height of 36 inches. The term "H.R" (high resilient) foam refers to a highly resilient foam that will give a very high "ball rebound" reading. Visco-elastic memory foam's low resilience indicates an increased force dampening. This low rebound value also gives carrying device 20 the ability to mold around handles 502 and to mold to the user's grip, without applying significant rebound force while in the compressed state (also refer to FIG. 14 and the associated discussion).

In an embodiment, device 20 is about four inches long (first end 28 to second end 30), about 2.25 inches high (top surface 24 to bottom surface 26), and about two inches wide (the distance across middle humps 50).

Figure 8:
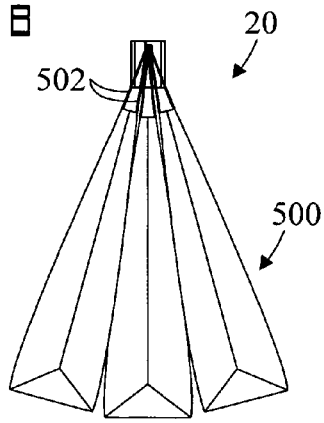
FIG. 8 is a reduced end elevation view of the device connected to a plurality of bags having handles.
Figure 9:
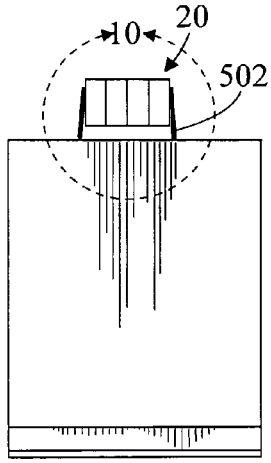
FIG. 9 is a reduced side elevation view of the device and bags.
Figure 10:
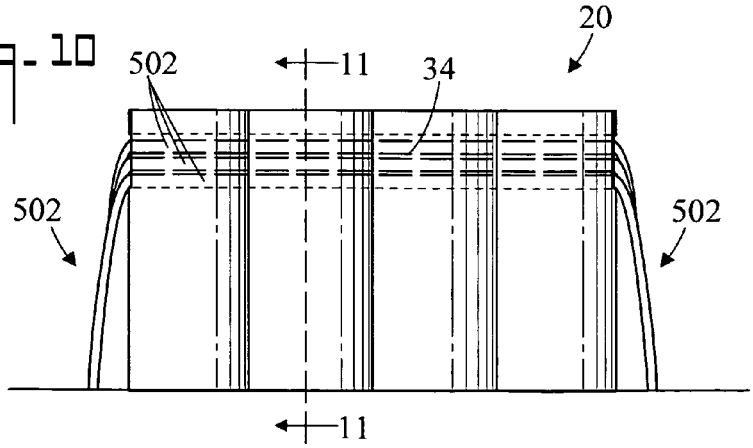
FIG. 10 is an enlarged view of area 10 of FIG. 9.

FIG. 8 is a reduced end elevation view of device 20 connected to a plurality of bags 500 having handles 502, and FIG. 9 is a reduced side elevation view of device 20 and bags 500, and FIG. 10 is an enlarged view of area 10 of FIG. 9. In the shown embodiment, device 20 is being used to carry three bags 500, however it may be appreciated that a lesser or greater number could also be carried. As is shown in FIGS. 9 and 10, handles 502 of bags 500 have been longitudinally inserted into longitudinal cavity 34 in preparation for gripping by a user.

Figure 11:
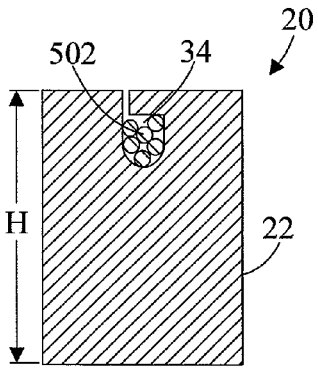
FIG. 11 is a cross sectional view along the line 11-11 of FIG. 10.

FIG. 11 is a cross sectional view along the line 11-11 of FIG. 10, and shows the plurality of handles 502 inserted in longitudinal cavity 34 of body 22. In the shown uncompressed state, body 22 has a height H.

Figure 12:
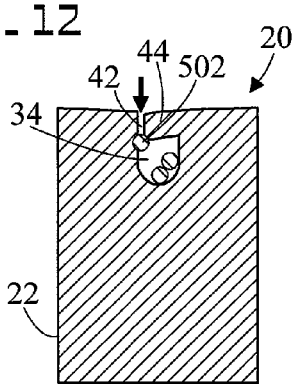
FIG. 12 is a cross sectional view as in FIG. 11 showing how the handles are inserted into the device.

FIG. 12 is a cross sectional view as in FIG. 11 showing how handles 502 are inserted into longitudinal cavity 34 of device 20. Handles 502 are pressed downward through slot 42 and into longitudinal cavity 34. Flap 44 moves to permit the insertion process, and then returns to the position of FIG. 11, to retain handles 502 in longitudinal cavity 34.

Figure 13:
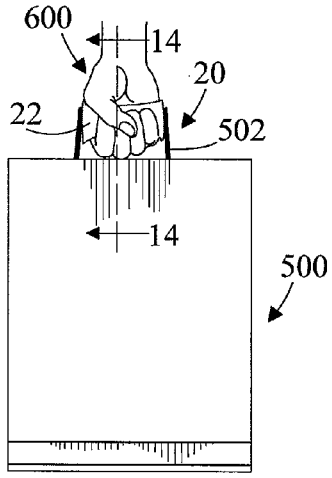
FIG. 13 is a reduced side elevation view of the device being gripped by the hand of a user.
Figure 14:
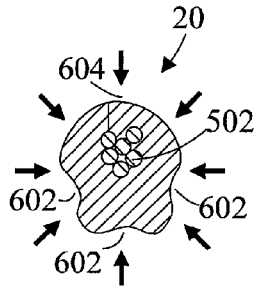
FIG. 14 is an enlarged cross sectional view along the line 14-14 of FIG. 13.

FIG. 13 is a reduced side elevation view of device 20 being gripped by the hand 600 of a user, and FIG. 14 is an enlarged cross sectional view along the line 14-14 of FIG. 13. Device 20 is suitable for gripping by the hand 600 of a user. When handles 502 of bags 500 are received by body 22 and body 22 is gripped by the hand 600 of a user, body 22 (1) molds around handles 502, (2) protects the hand 600 of the user, and (3) provides less rebound force than conventional foam materials. In other words, molded body 22 provides a larger gripping area and thereby distributes the concentrated force exerted by the handles 502 of the bags 500. Further, due to the properties of visco-elastic foam, molded body 22 does not apply significant rebound force (as compared to conventional foams) upon the hand 600 of the user while in the compressed state, and is therefore less tiring for the user 600 to grip. In another embodiment, body 22 is gripped by the fingers 602 of the hand 600 of the user. When the handles 502 of bags 500 are received by body 22, and body 22 is gripped by the hand 600 of the user, body 22 molds to the hand 600 of the user thereby providing equal pressure distribution along each of the fingers 602 of the hand 600 of the user. In another embodiment the user grips handles 502 between the fingers 602 and the palm 604 of the user's hand 600. When the plurality of bag handles 502 are received by body 22, and body 22 is gripped by the hand 600 of the user, any space between the palm 604 of the user's hand 600 and the handles 502 of the bags 600 collapses and thereby creates surface friction on all sides of the handles 502 to prevent slippage between the hand 600 of the user and the handles 502.

In another embodiment, when body 22 is not being used to carry bag handles 502, body 22 can be used as an isokinetic hand strengthening orthopedic exercise device and squeezed by a user so that body 22 compresses to a compressed height which is less than 20% of uncompressed height H (also refer to FIG. 11). Isokinetic orthopedic exercise requires movement, not just flexing of your grip. Because body 22 is designed to compress many times less than its original height, isokinetic (vs. isotonic) orthopedic exercise is possible Further, when body 22 is not being used to carry bag handles 22, body 22 can be compressed by a user's hand 600 to less than 40% of its uncompressed volume. In an embodiment, body 22 has an uncompressed state having a first volume, and a compressed state having a second volume. First volume is at least three times larger than the second volume. As such device 20 can be conveniently compressed and inserted into a small carrying pouch for travel.

It is noted in FIG. 14 that upon being gripped body 22 collapses and fills the space around handles 502 and effectively provides a "lock" around handles 502 from all sides. This provides stability in carrying bags 500 since there can be no slippage of handle 502 within body 22.

Figure 15:
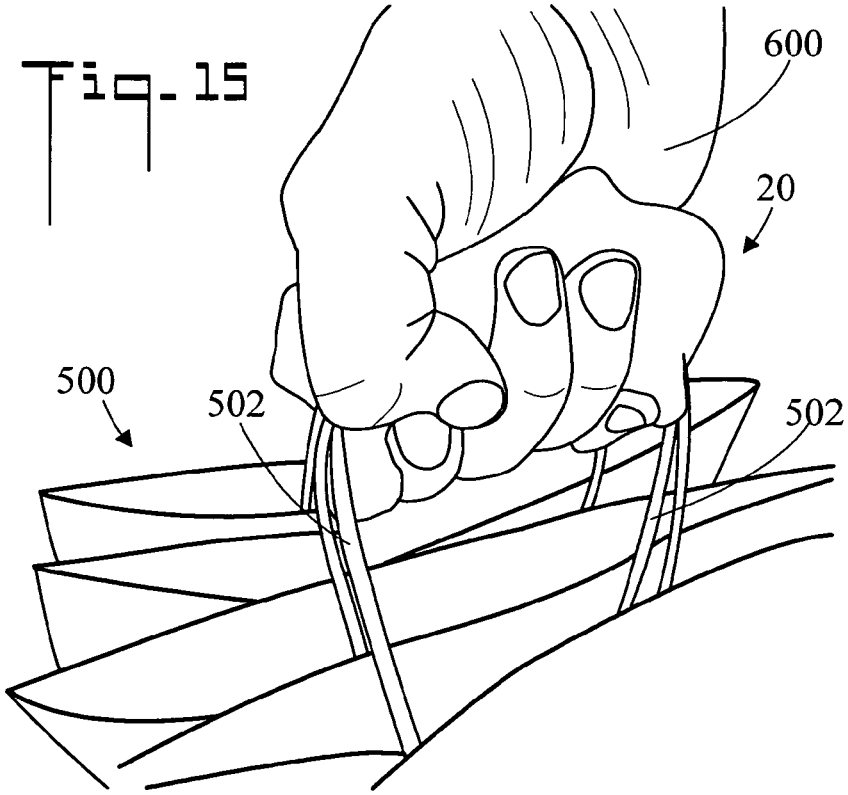
FIG. 15 is a perspective view of the device connected to the handles of a plurality of bags and gripped by the hand of a user; and, FIG. 16 is another perspective view of the device and handles being gripped by the user.
Figure 16:
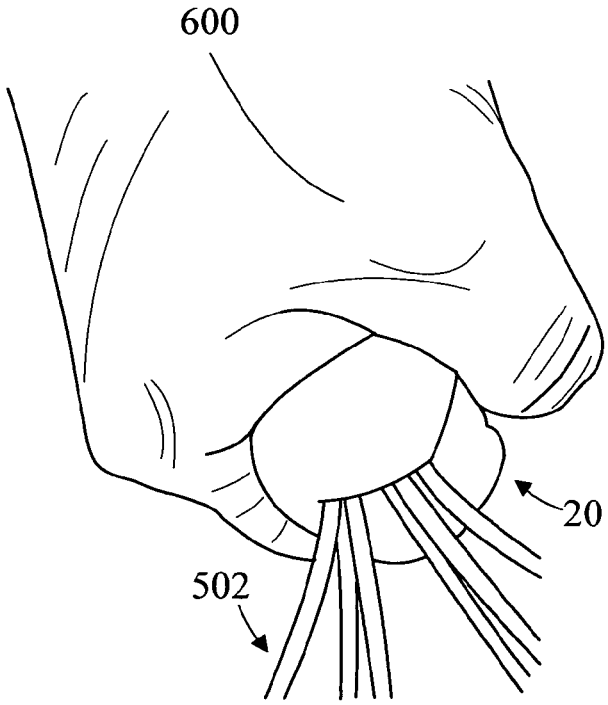

FIG. 15 is a perspective view of device 20 connected to the handles 502 of a plurality of bags 500 and gripped by the hand 600 of a user. And, FIG. 16 is another perspective view of device 20 and handles 502 being gripped by the user.

Visco-elastic foam is a relatively new technology that is widely used for mattresses and pillows. Since the main use is for the top layers for mattresses and pillows, the average firmness or ILD (indentation load deflection), has been approximately 15. Recently, there has been a new visco-elastic technology that has been created with much greater firmness, ranging from over 20, all the way up to 100. Additionally, the visco-elastic foam used in bedding has a lower tensile and tear strength than that of carrying device 20. Newer technologies have been able to substantially increase these two abilities. This much higher ILD range, tear strength and tensile strength has opened up a new range of possible uses. One such is an embodiment of the present invention, which utilizes approximately 65 ILD, 30 tensile strength and 6 tear strength foam. These parameters are many times more than the majority of visco-elastic foam as well as latex rubber on the market.

This high firmness, combined with high tensile and tear strength provide device 20 with the ability to be more durable and resist pressure more greatly than any such previous type of visco-elastic or conventional foam, and makes it suitable for a one piece design as a handle device carrier. With the almost complete compression of device 20 when the handles 502 of a bag 500 are applying downward forces, while the hand grip is closing around, the handles 502 become more locked into place and provide a more cushioning effect that can contour better around the hand occurs. As visco-elastic foam is a slow recovery foam, it will have a much greater initial stiffness over all other conventional polyurethane and latex rubber foams. This makes visco-elastic foam feel much firmer at first than other foams, but once pressure is applied, over time the air will displace from the visco-elastic foam and it can continue to compress and conform to whatever is applying pressure to it. This makes higher ILD visco-elastic foam (over 100) an unsuitable material for this present invention. If a softer ILD and weaker tear and tensile visco-elastic foam was substituted, this would not be as durable, as supportive and would put more pressure of the handles against the hand. Therefore, this invention would not be an obvious usage with the memory foam commonly found on the market.

The possible embodiments of the device described herein are exemplary and numerous modifications, combinations, variations, and rearrangements can be readily envisioned to achieve an equivalent result, all of which are intended to be embraced within the scope of the appended claims. Further, nothing in the above-provided discussions of the device should be construed as limiting the invention to a particular embodiment or combination of embodiments. The scope of the invention is best defined by the appended claims.

I claim:

1. A device for carrying a plurality of bags having handles, the device comprising;

a body made from visco-elastic foam;

said body including a receiver for removably receiving the handles of the bags;

said body having a first side and an opposite second side, and a first end and an opposite second end;

said first and second sides being scalloped and forming a plurality of vertically oriented elongated humps;

a central longitudinal axis which passes from said first end to said second end;

said first side and said second side each having four scallops including two middle scallops which define two elongated middle humps, and two end scallops which define two elongated end humps; and, said elongated middle humps extending further outwardly from said central longitudinal axis than said elongated end humps.

* * * * *